US005850190A

United States Patent [19]

Wicks et al.

[11] Patent Number: 5,850,190

[45] Date of Patent: Dec. 15, 1998

[54] TRAFFIC INFORMATION PAGER

[75] Inventors: James E. Wicks, San Francisco, Calif.; Eduardo Sciammarella, Hoboken, N.J.

[73] Assignees: Sony Corporation, Japan; Sony Electronics, Inc., Park Ridge, N.J.

[21] Appl. No.: 810,814

[22] Filed: Mar. 6, 1997

[51] Int. Cl.[6] ..... G08G 1/09

[52] U.S. Cl. ..... 340/905; 340/311.1; 340/825.44; 340/990

[58] Field of Search ..... 340/311.1, 905, 340/990, 825.44

[56] References Cited

U.S. PATENT DOCUMENTS

| | | | |
|---|---|---|---|
| 4,415,065 | 11/1983 | Sandstedt . | |
| 4,792,803 | 12/1988 | Madnick et al. | 340/905 |
| 4,812,843 | 3/1989 | Champion, III et al. | 340/905 |
| 4,951,039 | 8/1990 | Schwendeman . | |
| 5,121,126 | 6/1992 | Clagett | 342/419 |
| 5,173,688 | 12/1992 | DeLuca et al. . | |
| 5,206,641 | 4/1993 | Grant et al. | 340/905 |
| 5,331,431 | 7/1994 | Jasinski . | |
| 5,446,678 | 8/1995 | Saltzstein et al. . | |
| 5,452,356 | 9/1995 | Albert . | |
| 5,481,255 | 1/1996 | Albert et al. . | |
| 5,491,785 | 2/1996 | Robson et al. . | |
| 5,495,344 | 2/1996 | Callaway, Jr. et al. . | |
| 5,508,695 | 4/1996 | Nelson et al. . | |
| 5,535,428 | 7/1996 | King et al. . | |
| 5,543,789 | 8/1996 | Behr et al. | 340/995 |
| 5,649,289 | 7/1997 | Wang et al. | 455/31.3 |

*Primary Examiner*—Edward Lefkowitz
*Attorney, Agent, or Firm*—Ronald P. Kananen

[57] ABSTRACT

A novel paging system provides a apparatus and method for disseminating traffic condition information to subscribing commuters that is specific to the route or routes traveled by the commuter. An electronic map of the commuter's route is stored in the memory unit of a pager and is displayed, perhaps in segments controlled by the commuter. The location of and other information about actual and potential traffic problems is transmitted to the pager. The pager then displays icons on the displayed map which indicate the location of the problems. The icons may also differ to indicate the type or severity of the problem.

12 Claims, 3 Drawing Sheets

TRAFFIC INFORMATION PAGER

FIELD OF THE INVENTION

The present invention relates generally to the field of wireless pagers. More particularly, the present invention relates to an application of wireless pager technology as a means for receiving information regarding traffic conditions.

BACKGROUND OF THE INVENTION

Portable radio receivers and transceivers, such as wireless pagers, have become increasingly popular as a means of communication. Pagers are typically carried by users who wish or need to receive communications when they are away from a telephone or computer, or are unable to predict where they may be reached at a given time.

In general, the user of a pager purchases the unit and enters into a contract with a service provider. As shown in FIG. 1, when someone 12 wishes to page a particular user, they contact the user's service provider 11, identify the user to be paged (perhaps with a personal identification number), and may give a message to the service provider 11 that is to be broadcast to the user's pager 15.

The service provider 11 maintains a network of radio transceiver base stations 13, 14 which are spread throughout the service area covered by the service provider. The transmitting base stations 13 are distributed so that transmissions from at least one base station can be received by a pager 15 anywhere in the service area.

In a simplistic system, when the service provider 11 receives a request to page a user 15, the page is broadcast by all the base stations 13 in the system. Thus, if the pager 15 is located anywhere in the service area, it will receive the page. The pager 15 will then alert the user that a page has been received with, for example, an audible or vibratory alert signal.

In a more sophisticated system, the pager 15 may have the capability to not only receive a transmission from the service provider's system, but also to transmit an answer back to the system. This is referred to as two-way paging.

With these advances, the usefulness of pagers as a means of communication has expanded rapidly. Service providers have encouraged this expansion by experimenting with pagers as a means to disseminate information of interest to pager users. For example, as described in U.S. Pat. No. 5,508,695 to Nelson et al., incorporated herein by reference, a one-way pager system is used to relay sports or financial information to a pager user who has contracted with the service provider for that service.

However, there are many potential, undiscovered applications of pager technology which may provide pager users with, as yet unheard of, abilities to communicate. This is particularly true of the developing two-way pager systems. Accordingly, there is a need for improved methods and applications of pager technology to meet the information, recreation and communication demands of pager users.

Congested traffic conditions are a perennial problem for those who live in large urban areas. The problem is particularly acute for those who regularly commute in the high traffic volume of the rush hour. Frequently an alternate, less congested route may be taken if a commuter is alerted in advance of particular area of congestion. Accordingly, there is a need for an improved means of informing commuters about problem traffic areas along regularly traveled routes.

SUMMARY OF THE INVENTION

It is an object of the present invention to meet the above identified needs and others. More particularly, it is an object of the present invention to provide a novel pager and paging system and methods of using the same to provide commuters with traffic pattern information.

Additional objects, advantages and novel features of the invention will be set forth in the description which follows or may be learned by those skilled in the art through reading these materials or practicing the invention. The objects and advantages of the invention may be achieved through the means recited in the attached claims.

To achieve the stated and other objects of the present invention, as embodied and described below, the invention may encompass a paging system having: a database of traffic information; a central processor for accessing the database; and at least one transmitter for transmitting the traffic information to a pager.

The traffic information may comprise a location of at least one actual or potential traffic problem; an indication of the type and severity of the at least one traffic problem; and at least one route to be followed by a commuter. The processor correlates the location of the at least one traffic problem with the at least one route; and the transmitted information can then be specific to each the route.

The present invention also encompasses a pager for receiving and displaying traffic pattern information having: a controller; a memory unit, accessible to the controller, containing an electronic map of a commuter route; a display, driven by the controller, on which the map may be displayed; and an antenna. A transmission comprising traffic information may be received by the antenna, correlated to the map by the controller and displayed, along with the map, on the display.

The pager of the present invention may further include icons displayed on the display by the controller representative of the traffic information. The icons may vary to indicate a type or severity of a traffic problem.

A segment of the map may displayed on the display. The segment displayed may be changed by the controller in response to the actuation of a scroll key. The pager may also have a mounting device for mounting the pager in an automobile.

The present invention also encompasses a method of using a paging system to disseminate traffic information by: compiling a database of traffic information; accessing the database with a central processor; and transmitting the traffic information to a pager with at least one transmitter.

The compiling of traffic information may include determining a location of at least one actual or potential traffic problem. Also, the compiling of traffic information may further include indicating the type and severity of the at least one traffic problem. Finally, the compiling of traffic information may include determining at least one route to be followed by a commuter.

The present method may continue by: correlating the location of the at least one traffic problem and the at least one route; and transmitting information specific to each route.

The present invention also encompasses a method of using a pager for receiving and displaying traffic pattern information by: providing a controller; accessing a memory unit with the controller, the memory unit containing an electronic map of a commuter route; displaying the map on a display driven by the controller; receiving a transmission of traffic information with an antenna; correlating the traffic information to the map; and displaying the correlated traffic information with the map on the display.

The present method may continue by indicating, with a variety of icons displayed on the display, the location, type and severity of a traffic problem. When displaying the map, the present method may be performed by displaying a segment of the map; and changing the segment of the map displayed in response to the actuation of a scroll key. Finally, the method may include mounting the pager in an automobile.

BRIEF DESCRIPTION OF THE DRAWINGS

The accompanying drawings illustrate the present invention and are a part of the specification. Together with the following description, the drawings demonstrate and explain the principles of the present invention. In the drawings.

DETAILED DESCRIPTION OF THE PREFERRED EMBODIMENT

Using the drawings, the preferred embodiment of the present invention will now be explained. Under the principles of the present invention, pager technology can be adapted to provide a means and method to allow commuters to receive more timely and relevant information regarding traffic patterns and congestion.

Figure 1:
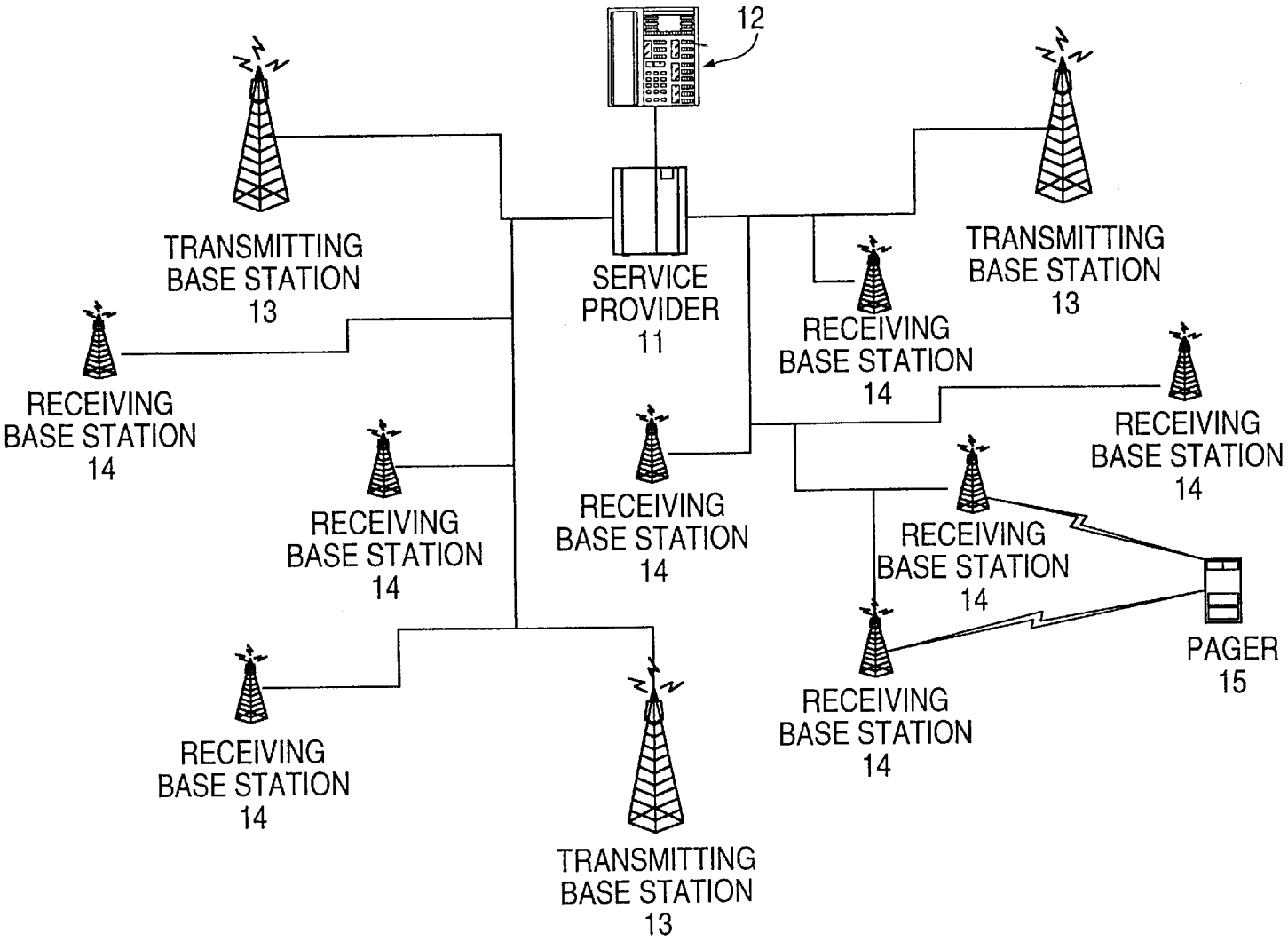
FIG. 1 is a schematic diagram of a conventional two-way paging network with which the present invention may be practiced.
Figure 2:
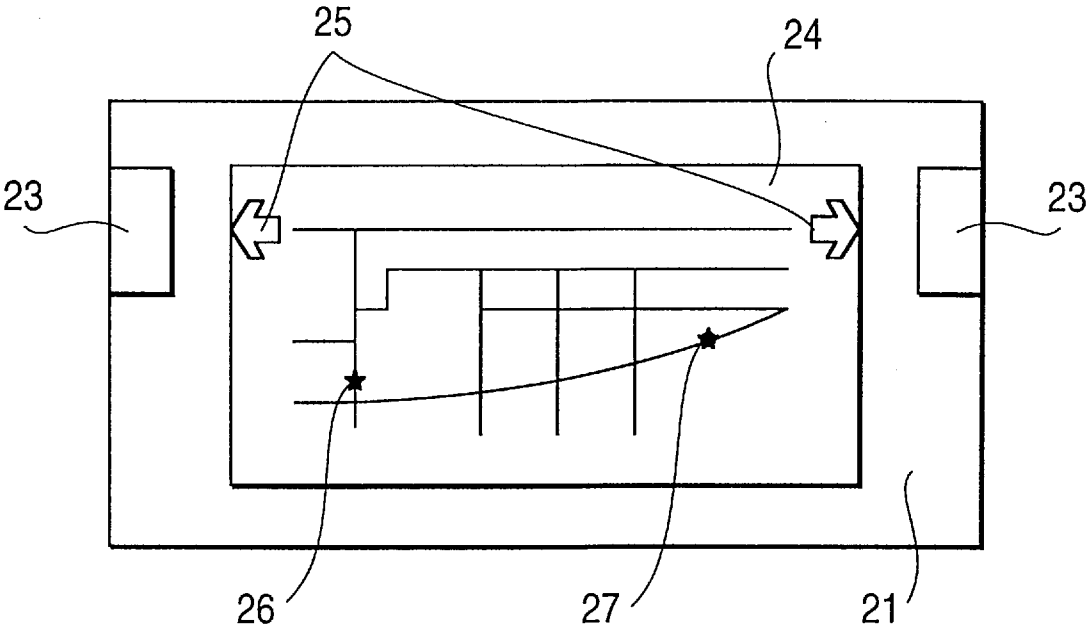
FIG. 2 is a diagram of a pager according to the principles of the present invention.

FIG. 2 illustrates a pager according to the principles of the present invention. As shown in FIG. 2, the pager 21 includes a display 24 and may include scroll keys 23.

As explained herein, the pager 21 will display a map or section of a map of a commuter's route on the display 24. Display 24 may be a liquid crystal display designed to display the map or segments of the map as required by the present invention.

In the event that a commuter's route is so long that a map of it cannot be conveniently displayed at one time on display 24, arrow icons 25 may also be displayed on display 24. When the arrow icons 25 are displayed, a commuter may scroll through the entire map of the route on the display by using scroll keys 23 as indicated by the arrow icons 25.

During the pager user's commute, the pager 21 may also display additional icons 26, 27 on the displayed map to indicate points at which the commuter may be delayed. For example, icon 26 may indicate the site of a traffic accident that has not yet be cleared away. Icon 27 may indicate the site of road construction. Additional icons may indicate the location of traffic congestion and other problems that may delay the commuter.

Figure 3:
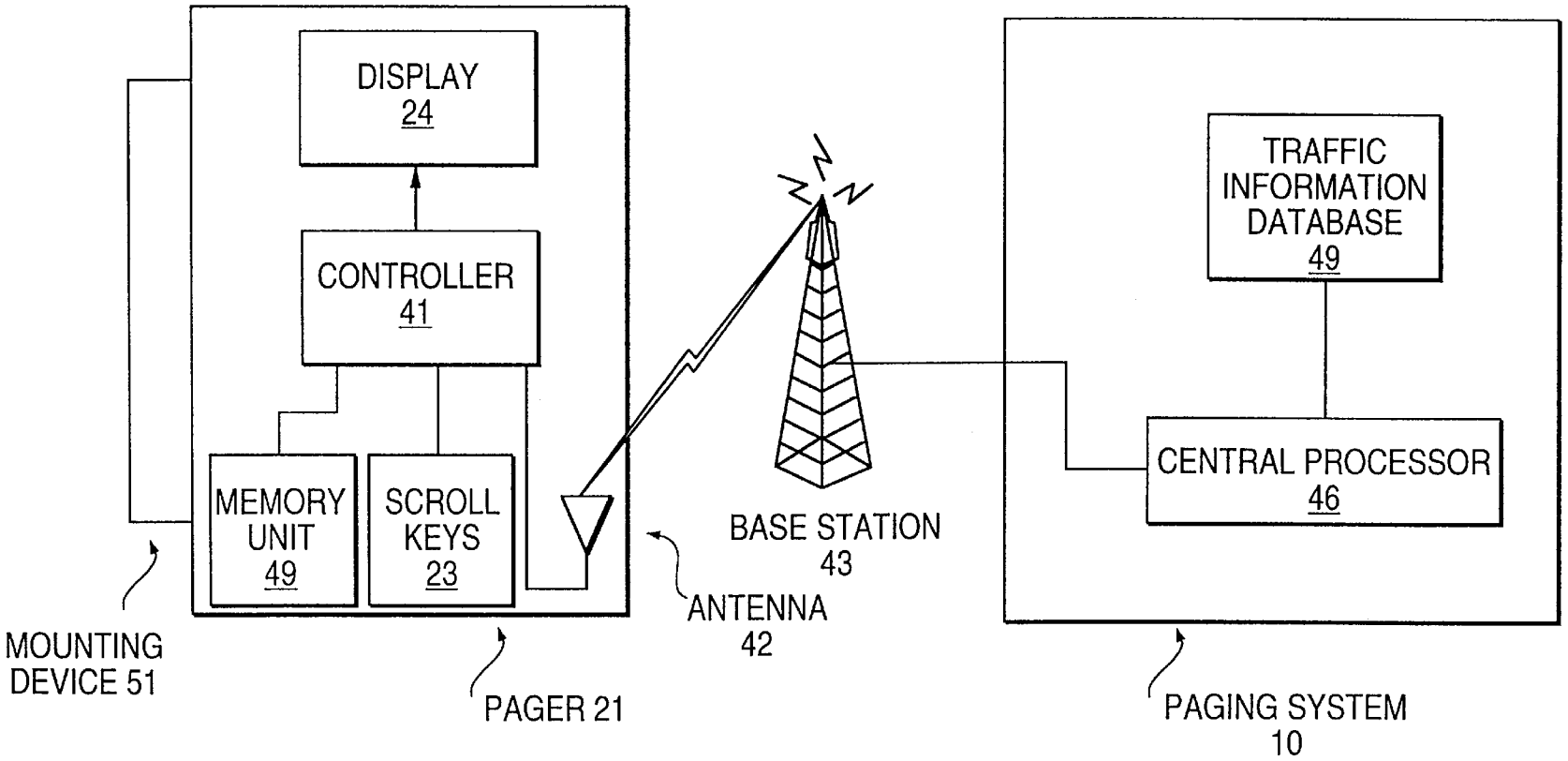
FIG. 3 is a diagram of the key components of the system of the present invention.

FIG. 3 illustrates the key components of the pager and paging system under the principles of the present invention. As shown in FIG. 3 and as indicated, pager 21 is provided with a display 24 and scroll keys 23. Pager 21 will also have a controller 41, a memory unit 49 and an antenna 42.

When the commuter contracts with the paging system service provider for the traffic information service, the service provider will obtain from the commuter a description of the commuter's typical route. If there are several available routes, the service provider may obtain a description of each from the commuter. The commuter's route will most likely take him or her to work, but could alternatively be any route regularly traveled by the commuter for any reason.

The service provider will then provide an electronic map of the route which is stored in memory unit 49. As indicated before, the map may be divided into several segments which are displayed separately.

When the commuter is making his or her commute, the controller 41 will access the map stored in memory unit 49 and will display the map on display 24. The user may control which segment of the map is displayed by operating scroll keys 23 as described above.

The service provider who operates paging system 10 will compile a database 49 of traffic information. The information in the database 49 may include the identification and route (or routes) of each commuter subscribing to the traffic information service.

The database 49 also includes information regarding traffic conditions. This information may be gathered, for example, by the service provider from newscasts or a radio receiver scanning frequencies used by police and other emergency services. Alternatively, the service provider may employ a helicopter or airplane to over-fly the area and report on traffic conditions.

The central processor 46 of paging system 10 will access the information in database 49. It will match the location of reported traffic congestion and potential traffic problems with the route(s) traveled by subscribing commuters. Using base station 43, the central processor 46 will then transmit data indicating the location of actual and potential traffic problems along a commuter's route. The processor 46 need only transmit that data to a particular commuter which is located along that particular commuter's route. The processor 46 may also indicate the type of traffic problem identified.

The pager 21 will receive the transmission from the paging system 10 through antenna 42. The controller 41 will then correlate the transmitted information with the map stored in memory unit 49 and, as shown in FIG. 2, display icons indicating the location of actual and potential traffic problems. Different icons may be used to identify different types of actual and potential problems, e.g. construction, accident, congestion, emergency, etc. Different icons may also be used to indicate the severity of a particular problem.

Accordingly, the commuter may use the information displayed on pager 21 to plan or reroute his or her commute. This may save the commuter considerable time that would otherwise by lost sitting in traffic.

Pager 21 may also be provided with a mounting device 51. The mounting device 51 can take a wide variety of forms known to those skilled in the art. The mounting device 51 allows the pager 21 to be secured to a car's sun-visor, dashboard, steering wheel, etc., so that it can be conveniently referred to by the commuter during the commute.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A pager for receiving and displaying traffic pattern information comprising:

a controller;

a memory unit, accessible to said controller, containing an electronic map of a commuter route;

a display, driven by said controller, on which said map may be displayed; and an antenna;

wherein a transmission comprising traffic information may be received by said antenna;

wherein said traffic information is correlated to said map by said controller and displayed, along with said map, on said display.

2. A pager as claimed in claim 1, further comprising icons displayed on said display by said controller representative of said traffic information, wherein said icons vary to indicate a type or severity of a traffic problem.

3. A pager as claimed in claim 1, further comprising scroll keys, wherein a segment of said map is displayed on said display and said segment is changed by said controller in response to the actuation of one of said scroll keys.

4. A pager as claimed in claim 1, further comprising a mounting device for mounting said pager in an automobile.

5. A method of using a pager for receiving and displaying traffic pattern information comprising:

providing a controller;

accessing a memory unit with said controller, said memory unit containing an electronic map of a commuter route;

displaying said map on a display driven by said controller;

receiving a transmission of traffic information with an antenna;

correlating said traffic information to said map; and displaying said correlated traffic information with said map on said display.

6. A method as claimed in claim 5, further comprising indicating, with a variety of icons displayed on said display, a location, type and severity of a traffic problem.

7. A method as claimed in claim 5, wherein said displaying said map further comprising:

displaying a segment of said map; and changing the segment of said map displayed in response to the actuation of a scroll key.

8. A method as claimed in claim 5, further comprising mounting said pager in an automobile.

9. A pager for receiving and displaying traffic pattern information comprising:

a controller located in and controlling said pager;

a memory unit, located in said pager and accessible to said controller, containing graphical data of an electronic map of a commuter route;

a display, driven by said controller, on which said map may be displayed graphically; and an antenna;

wherein a transmission comprising traffic information may be received by said antenna;

wherein said traffic information is correlated to said map by said controller and displayed, along with said map, on said display.

10. A pager as claimed in claim 9, further comprising icons displayed on said display by said controller representative of said traffic information, wherein said icons vary to indicate a type or severity of a traffic problem.

11. A pager as claimed in claim 9, further comprising scroll keys, wherein a segment of said map is displayed on said display and said segment is changed by said controller in response to the actuation of one of said scroll keys.

12. A pager as claimed in claim 9, further comprising a mounting device for mounting said pager in an automobile.

* * * * *